United States Patent [19]

Dunham et al.

[11] 4,120,311

[45] Oct. 17, 1978

[54] VACUUM OPERATED DEBRIS REMOVAL APPARATUS AND METHOD FOR A POWER BROOM

[75] Inventors: Charles L. Dunham; Thomas H. Kiernan, both of Grand Rapids, Mich.

[73] Assignee: Gravel-Vac Service Co., Inc., Grand Rapids, Mich.

[21] Appl. No.: 765,776

[22] Filed: Feb. 4, 1977

[51] Int. Cl.[2] ..... F01H 1/04

[52] U.S. Cl. ..... 134/6; 15/83; 134/121

[58] Field of Search ..... 15/79 R, 83–86, 15/340, 347, 348, 349; 134/6, 21

[56] References Cited

U.S. PATENT DOCUMENTS

| | | | |
|---|---|---|---|
| 485,577 | 11/1892 | Ethridge | 15/340 X |
| 2,263,722 | 11/1941 | Drumm | 15/83 |
| 3,833,961 | 9/1974 | Fortman et al. | 15/340 |
| 3,837,029 | 9/1974 | Kasper | 15/83 |
| 3,876,260 | 4/1975 | Moss et al. | 15/340 |
| 3,955,236 | 5/1976 | Mekelburg | 15/340 X |

*Primary Examiner*—Edward L. Roberts
*Attorney, Agent, or Firm*—McGarry & Waters

[57] ABSTRACT

Vacuum operated debris removal apparatus for a power broom comprises an enclosed hopper for collecting debris swept up by the power broom and vacuum removal apparatus for continuously removing the debris from the hopper and conveying the debris away from the apparatus. The hopper has an outlet in the bottom thereof and inclined sides leading to the outlet, so that debris collected in the hopper is urged by gravity toward the outlet. A vacuum manifold is attached to the outlet for applying a vacuum to the outlet. The hopper is independently supported on wheels and attached to the power broom such that the debris removal apparatus can be moved over the surface being cleaned along with the power broom without having the weight of the debris removal apparatus being carried by the brush of the power broom. This support mechanism is adjustable to vary the height of the hopper with respect to the power broom. The hopper is attached to the power broom by means of a pivotable attachment mechanism that permits the apparatus to be operated over uneven surfaces without affecting the performance of the power broom. The hopper encloses the front side of the power broom and a depending flexible skirt extends around the rest of the periphery of the rotating brush of the power broom, such that all dust and debris swept up by the power broom are retained within the debris removal apparatus.

19 Claims, 13 Drawing Figures

VACUUM OPERATED DEBRIS REMOVAL APPARATUS AND METHOD FOR A POWER BROOM

BACKGROUND OF THE INVENTION

1. Field of the Invention

The present invention relates to debris removal apparatus and methods and more particularly to a vacuum operated debris removal apparatus and method for use in connection with a power broom.

2. Description of the Prior Art

Most industrial and commercial buildings have generally flat roofs which are surfaced with a waterproof sealer such as tar or the like and covered with a coating of gravel. Periodically, such roofs require resurfacing. In order to resurface such a roof, it is first necessary to remove all dirt, debris, and excess gravel so that there will be a clean surface to permit adequate bonding of resurfacing materials.

Traditionally, roofs are cleaned manually by the use of brooms, shovels, and wheelbarrows to remove the gravel, dirt, and debris from the surface of the roof. This is a time consuming and laborious process and involves a substantial expense in labor. Moreover, the broom, shovel, and wheelbarrow method results in an imperfectly cleaned surface and produces large amounts of dust in the air, which is a health hazard to laborers.

One improvement in the hand cleaning operation heretofore developed is the use of a vacuum apparatus for removing gravel from roofs. In such an apparatus, an inlet nozzle, either carried by hand or mounted on a wheeled cart, is rolled across the roof, and gravel or the like picked up by the vacuum apparatus is conveyed through a long hose to a vacuum apparatus positioned on the ground. The vacuum apparatus includes a pump for drawing a vacuum in the line and a separating apparatus for separating the gravel and debris from the air conveyed through the line. Typically, the separator is mounted directly over a dump truck so that the gravel can be discharged directly into the dump truck.

As an alternative to sweeping up debris by hand, many contractors use a device commonly known as a power broom. A power broom is a motorized device wherein a rotating cylindrical brush mounted on the front of the frame brushes the gravel and debris in a forward direction from the power broom. Power brooms are relatively powerful devices and produce great clouds of dust, debris, and gravel in front of the power broom as the power broom is moved across the roof surface. This produces air pollution and constitutes a significant dust hazard to the operator of the apparatus, as well as anyone else in the area.

Generally, the brush of a power broom is positioned at an angle with respect to the direction of movement of the power broom so that gravel and debris is piled up in a row next to the path of the power broom. After the power broom has piled the gravel up in rows, the gravel is removed from the roof manually by use of shovels and wheelbarrows.

An object of the present invention is to provide a method and apparatus for cleaning a roof surface with the power broom, wherein gravel and debris swept up by the broom are removed effectively from the surface without manual labor, and dust emission from the power broom is minimized.

SUMMARY OF THE INVENTION

In accordance with the present invention, vacuum operated debris removal apparatus for a power broom comprises an enclosed hopper for collecting debris swept up by the power broom and vacuum removal apparatus for continuously removing debris from the hopper and conveying it away from the apparatus.

The hopper has an inlet for receiving debris from the power broom and an outlet for conveying debris from the hopper. The hopper and outlet are constructed so that debris collected in the hopper can be removed from the hopper by the outlet by the application of a vacuum to the outlet. A vacuum manifold for applying a debris removing vacuum to the hopper outlet includes an inlet connected to the hopper outlet and outlet adapted to be connected to a vacuum conduit. A support mechanism movably supports the hopper with respect to the surface so that the weight of the debris removal apparatus is not carried by the brush of the power broom. The support mechanism permits the debris removal apparatus to be moved over the surface with the power broom. The debris removal apparatus is attached to the power broom by an attachment mechanism that permits the hopper inlet to be maintained in position to receive debris from the power broom as the power broom is operated over the surface.

The attachment mechanism of the present invention is pivotable so as to permit the vacuum attachment to move independently of the power broom in passing over uneven surfaces.

The support mechanism of the present invention comprises a wheeled support mechanism independently supporting the hopper. The support mechanism is adjustable to vary the position of the hopper with respect to the surface over which the hopper is moved.

The interior of the hopper comprises a contoured floor including a sloped ramp or surface extending upwardly from the rotating brush and a downwardly extending channel mounted on the upper edge of the ramp. The hopper outlet is formed at the bottom of the channel, with the outlet including outlet openings extending the entire transverse width of the rotating brush. The vacuum manifold is attached on the underside of the outlet, with the manifold outlet leading to a vacuum hose in the vacuum system. The manifold preferably is an elongated tubular member with outlet openings along the side of the tubular member.

In operation, the brush sweeps the debris up the inclined ramp of the hopper, from which it falls over the upper edge of the ramp downwardly into the channel. The debris is conveyed by gravity and by the air flow created by the vacuum downwardly through the outlet openings in the hopper and outwardly through the vacuum manifold. The debris is then conveyed through the vacuum hose off of the roof to the dump truck.

The apparatus of the present invention completely eliminates the need for a broom, shovel, wheelbarrow, and manual labor in connection with the cleaning of roof surfaces. Moreover, this apparatus produces a cleaner roof surface and eliminates air pollution problems associated with brooms and particularly a power broom.

These and other features and advantages of the present invention are described below and shown in the appended drawings illustrating preferred embodiments of the present invention.

DETAILED DESCRIPTION OF PREFERRED EMBODIMENT

Figure 1:
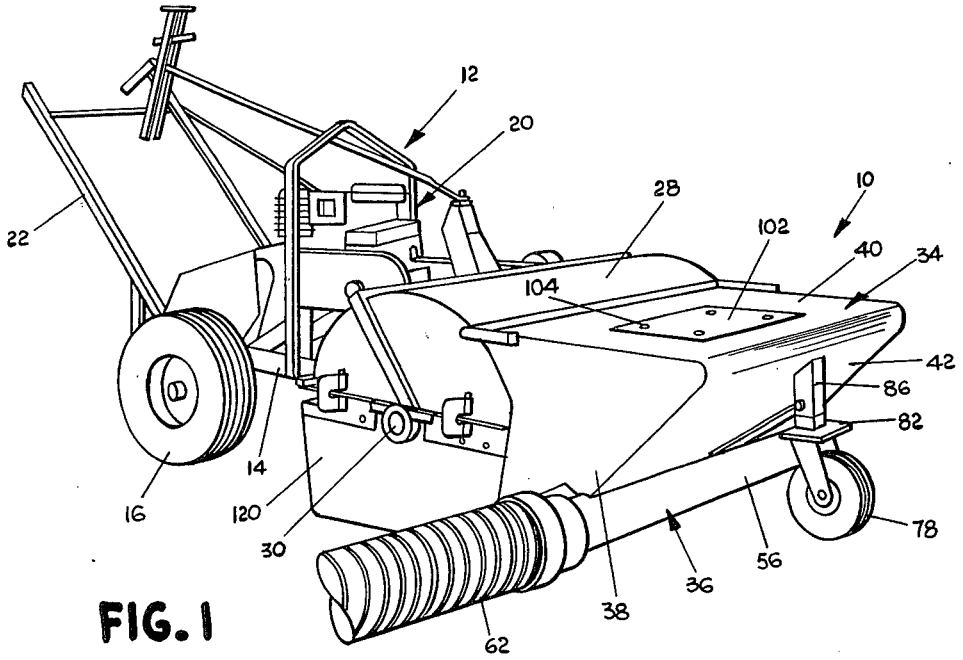
FIG. 1 is a perspective view showing the debris removal apparatus of the present invention mounted on a power broom.
Figure 2:
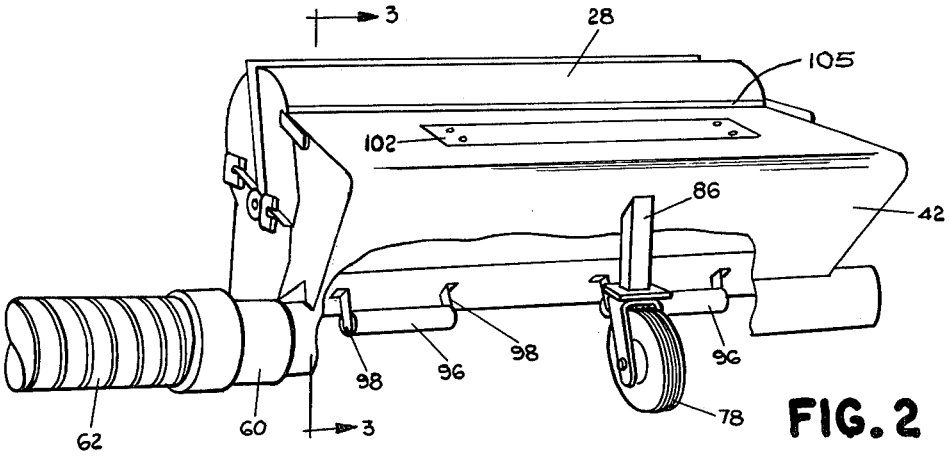
FIG. 2 is a broken perspective view of the debris removal apparatus of the present invention, showing the wheeled support mechanism for supporting the debris removal apparatus.
Figure 3:
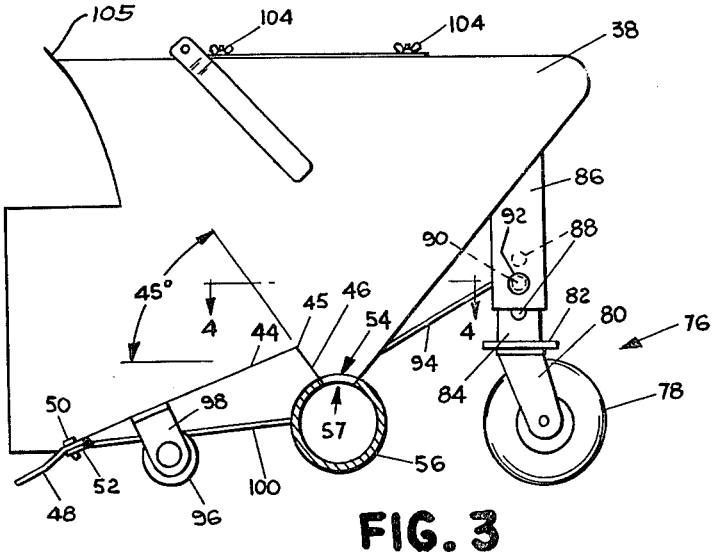
FIG. 3 is a view taken along line 3—3 of FIG. 2.
Figure 8:
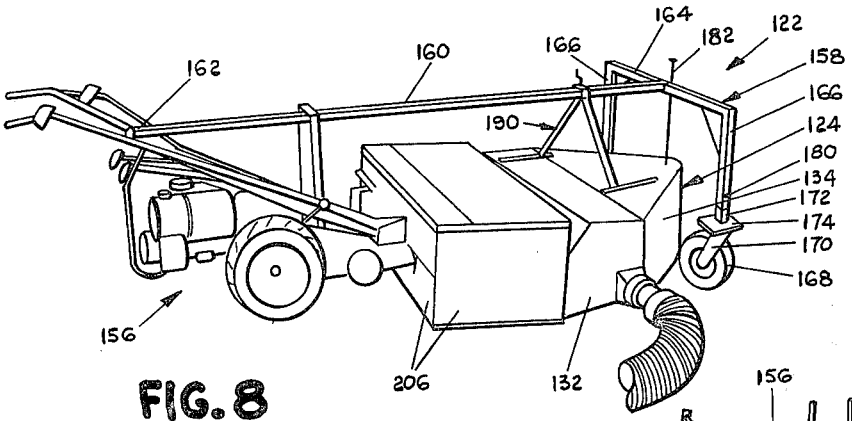
FIG. 8 is a perspective view showing a second embodiment of the debris removal apparatus of the present invention connected to a second type of power broom.
Figure 9:
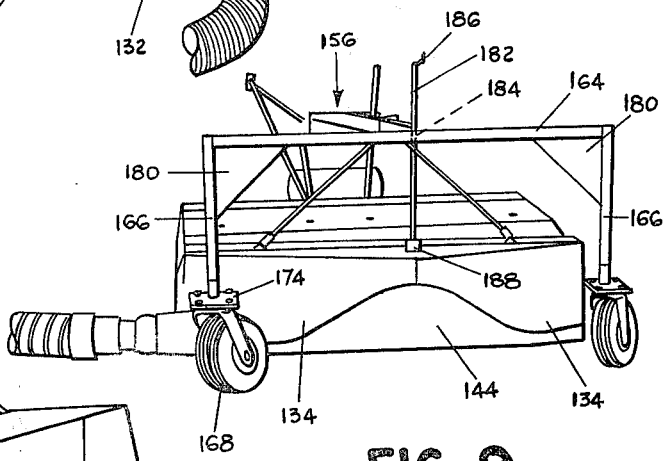
FIG. 9 is a perspective view of the apparatus of FIG. 8 shown from the front of the apparatus.
Figure 10:
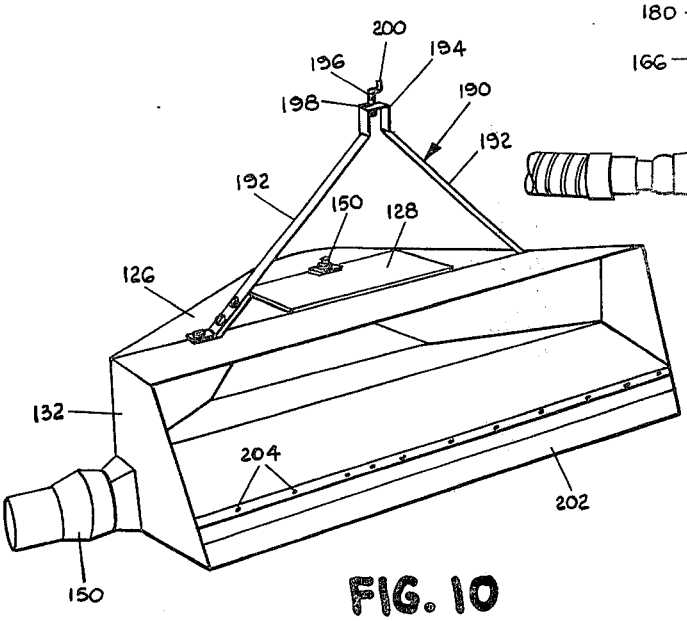
FIG. 10 is a perspective view showing the debris removal apparatus of FIG. 8 disconnected from the power broom.
Figure 11:
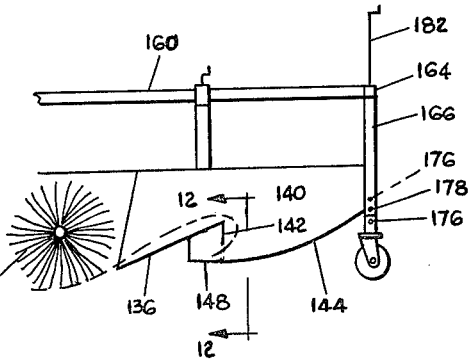
FIG. 11 is a schematic sectional side view of the debris removal apparatus of FIG. 8, showing the relationship between the rotating brush and the debris removal apparatus.

Referring to the drawings, debris removal apparatus 10 is shown mounted on the front end of a power broom 12 in FIG. 1. The power broom employed in connection with the present invention is conventional. The debris removal apparatus can effectively be employed on a number of different brands of power broom. The power broom shown in FIG. 1 is a Garlock brand, whereas the power broom shown in FIG. 8 is a different brand.

Power broom 12 comprises a frame 14 mounted on rear wheels 16 and front wheels 18. A gasoline engine 20 is mounted on the frame, and a handle 22 extends upwardly from the frame for manual guidance of the power broom. Engine 20 drives the vehicle through a conventional drive mechanism and operates the rotating cylindrical brush 24 through a chain drive mechanism 26 or the like. Brush 24 is rotatably mounted on an axle 30 and is enclosed in a housing 28. The drive mechanism rotates the brush in a counterclockwise direction (FIG. 6 orientation), so that the gravel and other debris are brushed forwardly from the power broom.

Power brooms are constructed so that the pressure on the rotating brush is carefully regulated. This is necessary in order to maximize the brushing effectiveness of the brush. In some power brooms, the rotating cylindrical brush is mounted in a fixed position with respect to the frame, and the support mechanism is adjustable to vary the position of the brush with respect to the roof surface 32 or similar surface over which the brush is moved. In other power brooms, the brush is pivotably or vertically movable with respect to the frame so that it rests independently on the surface. In either case, it is important that additional weight not be carried by the rotating brush.

The debris removal apparatus 10 of the present invention comprises an enclosed hopper 34 attached to the front end of hood 28 and a vacuum operated debris removal mechanism 36 mounted on the underside of the hopper.

Enclosed hopper 34 comprises vertical end panels 38, a flat top panel 40 and an inclined front panel 42. The floor of the hopper includes entry ramp or plate 44 that extends upwardly and inwardly away from the cylindrical brush at an angle of about 30° to an upper inward edge 45. A downwardly extending inclined plate 46 is attached to the inner edge of plate 44. Desirably, plates 46 and 44 are formed at angles of approximately 45° with respect to the horizontal.

A resilient dust seal 48 is fastened to the lower edge of plate 44 and extends downwardly therefrom into contact with surface 32 in order to seal the space between the outer side of the hopper and the surface and ensure that all debris and dust is received within the hopper. Seal 48 is formed of a resilient material such as gum rubber or the like and is attached to the lip of the plate 44 by means of suitable fasteners 50 or the like that extend through plate 44 and seal 48. Fasteners 50 engage a strip of metal 52 positioned on the underside of seal 48 to clamp seal 48 between plate 44 and metal strip 52.

Figure 6:
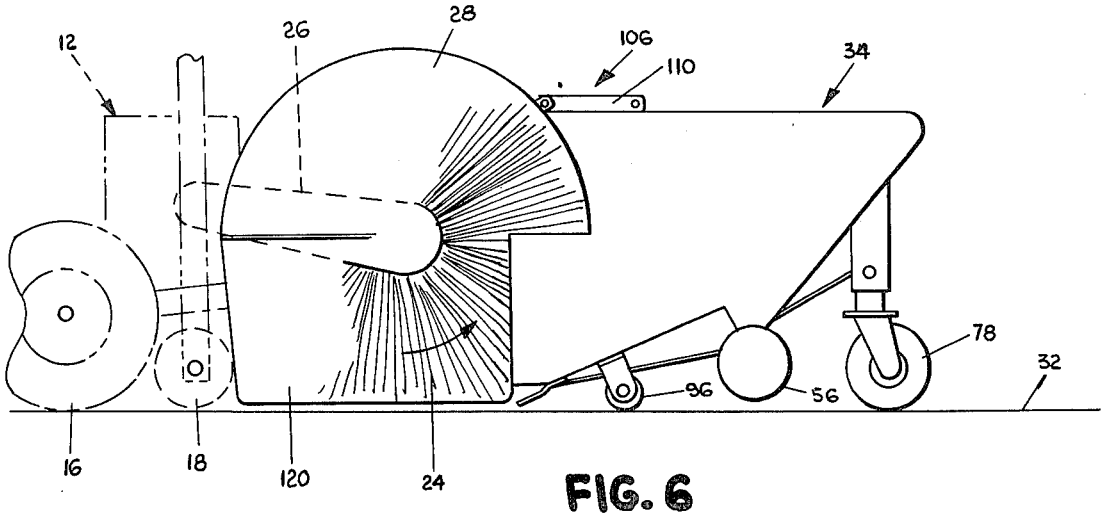
FIG. 6 is a partially broken side view of the present invention, showing the relationship between the rotating brush of the power broom and the debris removal apparatus.

Plate 44 forms an entry ramp into the hopper. As shown in FIG. 6, the rotating brush propels gravel and debris and dust up entry ramp 44 into the interior of the hopper. After material passes over the upper edge 45 of the entry ramp, the material falls downwardly between inclined plates 46 and 42. These plates form a transverse channel that extends all the way across the hopper. Debris received in the channel is urged by gravity toward the bottom of the channel. A hopper outlet 54 is formed at the bottom of this channel along the width of the hopper.

Figure 13:
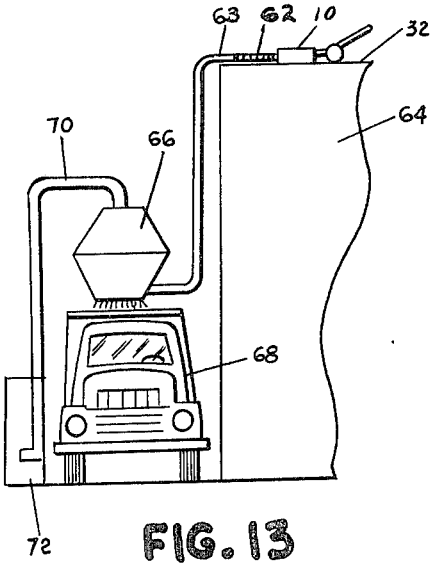
FIG. 13 is a pictorial view showing the use of the debris removal apparatus of the present invention for removing gravel and other debris from the roof of the building prior to resurfacing.
Figure 12:
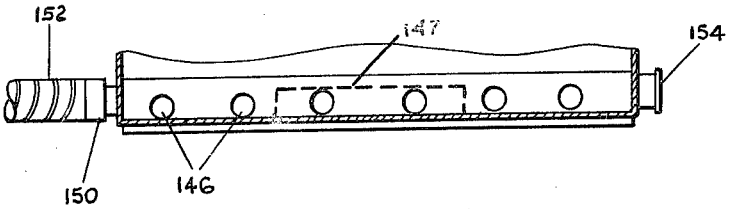
FIG. 12 is a sectional view taken along line 12—12 of FIG. 11.

The vacuum debris removal apparatus 36 is attached to the underside of the hopper at the outlet of the channel. The vacuum debris removal mechanism includes a vacuum manifold 56 formed of an elongated cylindrical tube mounted on outlet 54 of the hopper. Cylindrical tube 56 has a plurality of inlet openings 57 spaced along the length of outlet 54 and leading downwardly from the outlet into the interior of the vacuum manifold. One end of the vacuum manifold is closed with a removable cap 58 or other suitable closure. The other end of the manifold is provided with an outlet fitting 60, which is formed so as to be attachable to a flexible vacuum hose 62. As shown in FIG. 13, the flexible vacuum hose 62 extends from the debris removal apparatus 10 to a conduit 63 leading across the surface being cleaned (e.g. the flat roof of a building 64) and then downwardly to ground level where gravel and other debris is separated from the air stream created by the vacuum mechanism. Conduit 63 lead to a separator 66 mounted over a dump truck 68. In the separator, the gravel and debris are removed from the air stream and dumped downwardly into the dump truck. The air stream is then conveyed through a conduit 70 to vacuum pump 72, which draws the vacuum in the line. A filter bag of conventional design in incorporated into the pump mechanism to remove fine particulate material, such as dust or the like, that is not removed from the air stream along with the heavy debris in the separator. Pump 72 is shown for illustration purposes resting on the ground in FIG. 13. Desirably, the pump is mounted on a trailer that can be transported to and from a work site. Also, the separator desirably can be dismounted from the dump truck and mounted on the trailer along with the pump when the job is completed.

Figure 4:
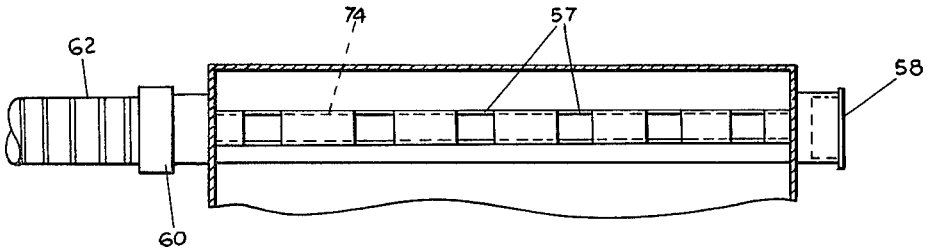
FIG. 4 is a sectional view taken along line 4—4 of FIG. 3.

In one type of vacuum removal apparatus, pump 72 is a centrifical pump capable of creating an air displacement rate of approximately 650 cubic fee per minute. With this type of pump, a four inch vacuum line is employed, and openings 57 are formed such that the total outlet area is approximately equal to the cross sectional area of the four inch pipe. In the embodiment shown in FIG. 4, six rectangular openings 57 of the same area are employed, and these openings are approximately equally spaced along the outlet of the hopper.

A more powerful vacuum pump also may be employed in the present invention, such as a positive displacement pump having an air displacement capability of approximately 915 cubic feet per minute. With such a pump, the inlet opening may comprise a slot 74 (shown by the dotted lines in FIG. 4) extending the entire length of the outlet opening in the hopper. It is desirable to make the inlet opening in the vacuum manifold as large as is feasible, while still creating sufficient vacuum force, so as to maximize the efficiency and rate at which the debris can be removed from the hopper.

Hopper 34 is independently supported on the surface 32 by means of wheeled support mechanism 76. Support mechanism 76 comprises a centered wheel 78 mounted at the front of the hopper and a pair of spaced rollers 96 mounted at the rear of the hopper.

Wheel 78 is rotatably mounted between the sides of U-shaped bracket 80. Bracket 80 is in turn pivotably mounted for horizontal rotation on a pivot plate 82. Pivot plate 82 is attached to an upwardly extending channel member 84 of rectangular cross section. Channel member 84 extends into the interior of a slightly larger channel member 86, which is rigidly attached to front panel 42 of the hopper. Channel member 84 is slidable in channel 86 to vary the height of wheel 78. Channel member 84 includes a plurality of transverse, vertically spaced openings 88 therethrough, and channel member 86 includes at least one transverse opening 90 that is capable of mating with the openings 88. A fastener 92 extends through opening 90 and one of openings 88 to position the wheel at any desired height with respect to the hopper. A strut 94 extends from channel member 86 to the front panel 42 to provide additional support for the wheel.

The rear end of hopper 34 is supported by spaced rollers 96. These rollers are mounted on the underside of plate 44 by means of brackets 98 of conventional design. Rollers 96 are preferably of rubber and are approximately two and onehalf inches in diameter. A strut 100 extends from the underside of plate 44 to vacuum manifold 56 in order to provide additional support for the vacuum manifold.

Upper panel 40 of the debris removal apparatus includes a removable section or access door 102, which is held in position on the panel by means of wing nut fasteners 104. Access door 102 can be removed at will in order to clean out the hopper or otherwise provide access to the interior of the hopper while the hopper is attached to the power broom. An upwardly inclined lip 105 is formed at the rear edge of panel 40 to provide a flush mating engagement between panel 40 and hood 28. Lip 105 permits relative pivotal movement between the top panel and hood, while still preventing dust from escaping at the junction between the two components.

Figure 5:
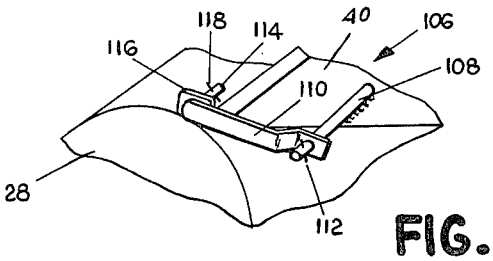
FIG. 5 is a perspective view of the attachment mechanism for attaching the debris removal apparatus to the power broom.

The debris removal apparatus is attached to the power broom by means of an attachment mechanism 106 shown in detail in FIG. 5. Attachment mechanism 106 comprises a cylindrical stud 108 attached to the upper surface of panel 40 and extending outwardly from the sides thereof. A hinge arm or bracket 110 is pivotably mounted on the outer end of stub 108 and a pin 112 extending through an opening in the outer end holds the bracket on the stud. The other end of bracket 110 has a cylindrical stud 114 extending inwardly therefrom. This stud passes through an opening in a tab 116 extending upwardly from hood 28. A pin 118 extending through an opening in the end of stud 114 holds stud 114 in position in the opening in tab 116.

Figure 7:
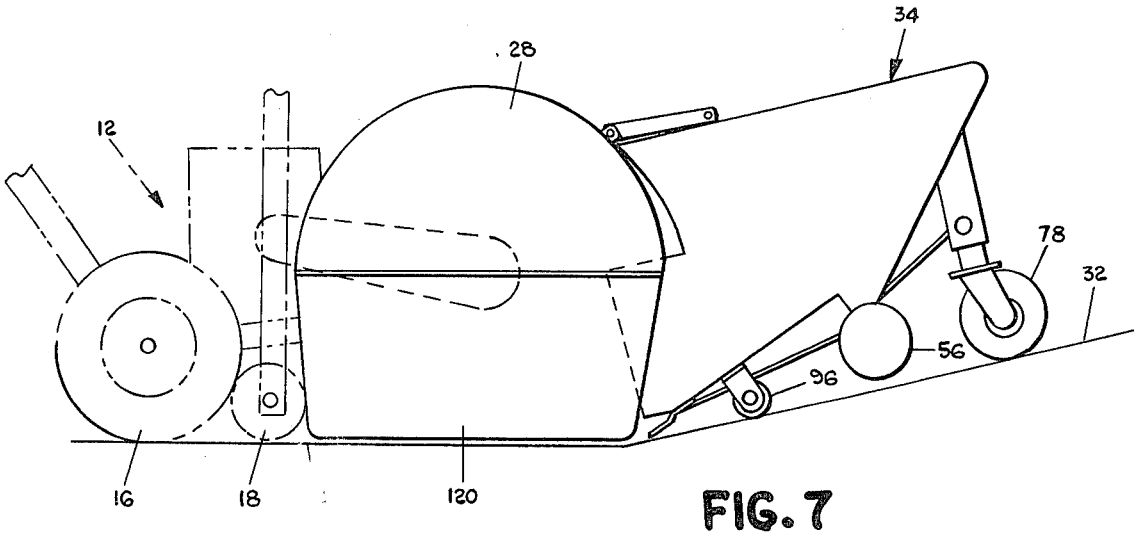
FIG. 7 is a side view similar to FIG. 6 showing the movement of the power broom and the debris removal apparatus over an uneven surface.

A separate pivotal joint of this nature is mounted on each side of the debris removal apparatus. This attachment mechanism provides a pivotable interconnection between the debris removal apparatus and the hood of the power broom. This facilitates use of the present invention on surfaces that are uneven, as shown in FIGS. 6 and 7. As shown in FIG. 6, when the surface is even, the apparatus rolls smoothly along the surface of the roof. When the roof surface is uneven, as shown in FIG. 7, the attachment mechanims 106 permits the debris removal apparatus to pivot upwardly onto inclined surface 32' while the power broom is still on flat surface 32. Without such a pivotable interconnection, movement of the debris removal apparatus onto such an inclined surface would tend to lift the brush from the surface of the roof at the junction between the inclined surface and the flat surface. The attachment mechanism nonetheless is secure enough so that the debris removal apparatus is maintained in debris receiving position in front of the power broom.

In order to minimize the amount of dust discharged into the air by the power broom, a resilient skirt 120 is attached to the bottom edge of hood 28 and extends around the other three sides of the lower half of the rotating brush. Skirt 120 is formed of rubber or the like and completes the enclosure of the rotating brush. With skirt and hopper completely enclosing the rotating brush, virtually all debris and dust are removed from the roof surface through vacuum removal means 36. Thus, air pollution and the resultant health hazard to laborers operating the power broom are avoided.

The foregoing embodiment of the present invention is the preferred embodiment of the present invention. A second embodiment 122 of the present invention is shown in FIGS. 8–12 in connection with a second type of power broom 156. In this embodiment, the enclosed hopper 124 includes a flat upper panel 126 having a removable access door 128 secured in place by a suitable fastener 130. Side panels 132 enclose the sides of the hopper, and front panels 134 enclose the front of the hopper. Front panels 134 extend inwardly at an inclined angle from the front edge of the side panels 132 so as to give the hopper a pointed nose.

The pointed nose is significant because it urges the debris propelled into the hopper to move to the center of the hopper as it strikes the front panels. The debris then slides down the bottom panel to the outlet, with the bulk of the debris being concentrated in the center of the hopper.

The floor or bottom panel of the hopper includes an upwardly inclined entry ramp or plate 136 extending upwardly from rotating brush 138 to the interior of the hopper to an upper edge 140. A vertical plate 142 extends downwardly from upper edge 140 to a bottom panel 144. Panel 144 extends in a curved manner upwardly into contact with front panels 134, so as to create a downward slope from the front of the interior of the hopper toward plate 142.

A plurality of outlet openings 146 are spaced along the lower edge of plate 142. These openings correspond with inlet openings in the side of a hollow vacuum outlet manifold 148 formed behind plate 142. An outlet fitting 150 adapted to be connected to flexible vacuum conduit 152 is attached to one end of the tubular vacuum manifold, while a removable cover door 154 is fitted on the other end of the manifold.

As an alternative to multiple outlet openings, a single outlet opening 147 could be formed in the center of plate 142. Because the pointed nose concentrates the debris in the center of the hopper, a single large opening can be employed in the center instead of the smaller openings spread out over the width of the hopper. The increased opening height possible with this arrangement enhances debris removal, especially when removing larger elements of debris. It is also contemplated that even larger or wider openings could be used with more powerful vacuum pumps.

The enclosed hopper is mounted on power broom 156 by means of a mounting mechanism 158. Mounting mechanism 158 includes a beam 160 attached at one end 162 to the frame or handle of the power broom and attached at the other end to the center of a cross bar 164. Cross bar 164 has legs 166 extending downwardly from each end thereof to pivotable wheels 168 mounted on the lower end thereof. Legs 166 are hollow channel members, and wheels 168 are mounted in these channel members in the same manner as wheel 78 in the first embodiment of the present invention. Each wheel 168 is rotatably mounted between the legs of a U-shaped bracket 170, and the upper portion of each bracket 170 is pivotably mounted to the lower end of a channel member 172 by means of a pivot plate 174 that permits the wheels to be pivoted with respect to the legs. Channel 172 has a rectangular cross section and mates with the internal rectangular surface of legs 166. Channel member 172 includes a plurality of transverse openings 176 therethrough that are capable of mating with an opening 178 in leg 166. A fastener 180 extends through the openings to hold the wheels in a desired location with respect to the legs. The legs are braced with respect to cross bar 164 by means of triangular plates 180 that extend between the legs and the cross bar.

The nose or front end of enclosed hopper 124 is suspended from the middle of cross bar 164 by means of a threaded rod 182, which is threaded into an axial opening 184 in cross bar 164, such that rod 182 is movable longitudinally through the opening by rotation of the rod. A crank 186 for rotating the rod is mounted at the upper end of the rod. A lower end of the rod is attached to the nose of the hopper by means of a fitting 188 that permits rotation of the rod in the fitting. By turning crank 186, the nose of the hopper can thus be raised or lowered with respect to the cross bar.

The rear portion of hopper 124 is attached to beam 160 by means of a Y-shaped yoke 190. Yoke 190 includes a pair of legs 192 that are attached to the upper surface of the hopper at lower ends thereof and extend upwardly and inwardly to a downwardly facing channel member 194 interconnecting the upper ends thereof. The downwardly facing channel member fits over the top surface of beam 160. A threaded rod 196 is engaged in a threaded opening 198 in the upper end of channel member 194, and a crank 200 on the upper end of the rod permits the rod to be turned and moved axially with respect to channel member 194. The lower end of rod 196 rests on beam 160. The rear portion of hopper 124 can be raised and lowered by turning crank 200 and thereby moving rod 196 in a vertical direction while engaging beam 160.

The foregoing support apparatus provides independent support of the hopper in front of the broom so that the weight of the hopper does not bear downwardly on the rotating brush as the power broom is operated. The various adjustment features permit accurate adjustment of the position of the enclosed hopper in front of the rotating brush so as to maximize the effectiveness of the hopper in collecting debris, while minimizing dust emissions.

The entry ramp 136 of the hopper includes a resilient seal 202 of the same general design as in the first embodiment. Resilient seal 202 is attached to the underside of plate 136 by suitable fasteners 204, shown in FIG. 10.

The vacuum removal apparatus of the second embodiment is attached to a suitable vacuum removal system of the same general type shown in FIG. 13 and described above.

Gravel and debris are removed from a roof surface or other suitable surface by the power broom apparatus of the present invention in the following manner. The brush rotates in a counterclockwise direction and propels debris and dust into the interior of the enclosed hopper. The downwardly extending plate at the upper edge of the entry ramp prevents the debris from rolling back down the ramp through the inlet of the hopper once it has been propelled over the upper edge of the entry ramp. After the debris passes over the upper edge of the entry ramp, it is urged downwardly by the force of gravity to cover the outlet openings in the hopper. The application of a vacuum within the vacuum manifold creates an air flow outwardly through the outlet openings and this causes the debris to be entrained in the air flow and drawn through the outlet openings to the separator 66.

It is also contemplated that the vacuum attachment can be used as a vacuum removal device apart from the power broom. Gravel or other debris can be shoveled into the hopper directly through the access door, or the hopper can be removed from the power broom and gravel shoveled into the exposed inlet of the hopper.

The vacuum operated debris removal apparatus of the present invention greatly reduces the time, effort, and expense required to clean a surface that is heavily loaded with debris, such as a roof surface being prepared for resurfacing. Moreover, this apparatus greatly improves the efficiency and effectiveness of the cleaning operation and eliminates air pollution resulting from dust emissions.

It should be understood that the foregoing embodiments are merely illustrative of the preferred practice of the present invention and that various modifications and changes may be made in the arrangements and details of construction of the apparatus described and shown herein, without departing from the spirit and scope of the present invention.

The embodiments of the invention in which an exclusive property or privilege is claimed are as follows:

1. Vacuum operated debris removal apparatus for a power broom wherein debris is brushed from a surface by a rotating cylindrical broom, said debris removal apparatus comprising:

enclosed hopper means for collecting debris swept up by the power broom, said hopper means having inlet means for receiving debris from the power broom and outlet means for conveying debris from the hopper means, the hopper and outlet means being constructed such that debris collected in the hopper means can be removed from the hopper means through the outlet means by the application of a vacuum to the outlet means;

vacuum manifold means for applying a debris removing vacuum to the hopper outlet means, said manifold means including inlet means connected to the hopper outlet means and outlet means adapted to be connected to a vacuum source;

support means for movably supporting the hopper means with respect to the surface such that the weight of the debris removal apparatus is not carried by the brush of the power broom, the support means permitting the debris removal apparatus to be moved over a surface with the power broom; and attachment means for attaching the debris removal apparatus to the power broom such that the hopper inlet means is maintained in position to receive debris from the power broom as the power broom is operated over the surface.

2. Vacuum operated debris removal apparatus according to claim 1 wherein the hopper outlet means is formed in a lower portion of the hopper means such that debris collected in the hopper means covers the hopper outlet means, the application of a vacuum to the hopper outlet means creating an air flow through the outlet means that urges the debris out of the hopper means through the hopper outlet means.

3. Vacuum operated debris removal apparatus according to claim 2 wherein:

the rotating brush extends generally across the front of the power broom and brushes the debris generally forwardly from the broom;

the enclosed hopper means extends across the front of the rotating brush and includes an upwardly inclined entry ramp leading from the brush upwardly into the interior of the hopper means to an upper edge, a channel portion being attached to the upper edge and extending downwardly therefrom along the width of the hopper, the channel portion having sides that are sloped such that the debris slides down the channel to the bottom thereof under the influence of gravity, the hopper outlet means being formed at the bottom of the channel and extending across at least a portion of the width of the channel; and the vacuum manifold means comprises a tubular conduit mounted on the hopper means at the hopper outlet means and extending transversely across the width of the channel, the inlet means of the vacuum manifold means comprising inlet openings in the side of the conduit in communication with the hopper outlet means and the outlet means of the vacuum manifold means being an open end of the tubular conduit.

4. Vacuum operated debris removal apparatus according to claim 3 wherein the hopper means includes an inwardly tapered front portion that deflects the debris into the center of the hopper means as it is received from the power broom, the hopper outlet means being enlarged in the center of the hopper means so as to accommodate the removal of debris concentrated in the middle of the hopper means.

5. Vacuum operated debris removal apparatus according to claim 1 wherein the support means comprises at least one wheel rotatably mounted on the front portion of the hopper means, the wheel being pivotable about a generally vertical axis to permit directional change of the debris removal apparatus, the support means further including roller means rotatably mounted on the underside of the hopper means at the rear portion thereof, the wheel and roller means being positioned to independently support the hopper means on the surface over which the apparatus is operated.

6. Vacuum operated debris removal apparatus according to claim 5 wherein the distance that the wheel extends downwardly from the hopper means is adjustable to vary the height of the hopper over the surface.

7. Vacuum operated debris removal apparatus according to claim 1 wherein the support means includes:

a support frame comprising an elongated beam attached to the power broom at one end and extending forwardly therefrom to a front end, the beam being supported at the front end in a generally horizontal position by a wheeled yoke, the wheeled yoke having a transverse cross bar attached at its midpoint to the beam and having legs extending downwardly from the ends of the cross bar, the wheels being pivotably mounted on the lower ends of the legs in ground engaging position, the cross bar and beam being mounted above the enclosed hopper means;

a threaded front support rod received in a threaded opening at the front of the support frame and extending downwardly to the front of the hopper means, the lower end of the front support rod being rotatably attached to the hopper means, the support rod being vertically movable by rotating the rod to raise and lower the front end of the hopper means; and a downwardly facing yoke having legs attached to the rear portion of the hopper means at lower ends thereof, the legs being connected together at upper ends thereof and fitting over the beam, the interconnected upper ends including threaded adjustment means for holding the upper ends at variable desired heights with respect to the beam.

8. Vacuum operated debris removal apparatus for a power broom, wherein solid particulate debris is brushed from a surface by a rotating cylindrical broom, said debris removal apparatus comprising:

enclosed hopper means attached to the power broom for collecting debris swept up by the power broom; and vacuum removal means for continuously removing and conveying the debris away from the hopper means and power broom means while the power broom is being operated, the vacuum removal means being operated by a vacuum source separated from and not carried by the hopper means or power broom means, the vacuum source being interconnected with the hopper means by conduit means for conveying debris away from the hopper means and power broom means toward the vacuum source.

9. Vacuum operated debris removal apparatus according to claim 8 wherein:

the hopper means has an outlet at a lower portion thereof and inclined sides leading downwardly to the outlet, such that debris collected in the hopper means is urged by gravity toward the outlet; and the vacuum removal means comprises vacuum manifold means attached to the hopper outlet for applying a vacuum to the hopper outlet, said vacuum manifold means including inlet means in communication with the hopper outlet and outlet means adapted to be connected to the vacuum source, the vacuum source creating an outward air flow through the hopper outlet means.

10. Vacuum operated debris removal apparatus according to claim 8 wherein the power broom is pivotably mounted on wheels such that the operator can raise and lower the brush by pivotal movement of the frame, downward pressure on the power broom at a position adjacent the broom increasing the downward pressure on the broom, the hopper means being independently supported on wheels and attached to the power broom such that the debris removal apparatus can be moved over the surface being cleaned along with the power broom without having the weight of the debris removal apparatus bearing downwardly on the brush of the power broom.

11. Vacuum operated debris removal apparatus according to claim 10 wherein the hopper means is supported by support means including at least one front wheel attached to the front of the hopper, the front wheel being pivotable about a generally vertical axis, the support means further including at least one roller rotatably mounted on the underside of the hopper means adjacent the rear portion thereof.

12. Vacuum operated debris removal apparatus according to claim 11 wherein the height of the front wheel is adjustable.

13. Vacuum operated debris removal apparatus for a power broom, wherein debris is brushed from a surface by a rotating cylindrical broom, said debris removal apparatus comprising:

enclosed hopper means attached to the power broom for collecting debris swept up by the power broom, the hopper means being attached to the power broom by attachment means that permits at least limited independent upward and downward vertical movement of the debris removal apparatus relative to the power broom, such that the power broom and debris removal apparatus can be operated over uneven surfaces without adversely affecting the operation of the power broom; and vacuum removal means for continuously removing and conveying the debris away from the hopper means while the power broom is being operated.

14. Vacuum operated debris removal apparatus according to claim 13 wherein the attachment means comprises hinge means interconnecting the power broom and debris removal apparatus such that the debris removal apparatus can pivot upwardly and downwardly with respect to the power broom but is held in sideways alignment with the rotating brush.

15. Vacuum operated debris removal apparatus according to claim 14 wherein the hinge means includes a hinge arm pivotably attached at one end to the power broom and at the other end to the debris removal apparatus.

16. Vacuum operated debris removal apparatus for a power broom, wherein debris is brushed from a surface by a rotating cylindrical broom, said debris removal apparatus comprising:

enclosed hopper means attached to the power broom for collecting debris swept up by the power broom, the enclosed hopper means extending transversely all the way across the width of the rotating brush and enclosing the front portion thereof;

a hood attached to the power broom enclosing the upper portion of the rotating brush, the hood and hopper means being formed so as to minimize dust emissions between the hood and the hopper means;

the hopper means being attached to the power broom by means of attachment means comprising at least one hinge arm pivotally connected at one end to the hood and pivotally connected at the other end to the hopper means, said hinge arm permitting vertical pivotal movement of the hopper means with respect to the hood but restraining sideways movement of the hopper means with respect to the hood;

flexible skirt means depending from the hood to the surface and enclosing the portions of the rotating broom not enclosed by the hopper means and hood so as to restrict dust emissions; and vacuum removal means for continuously removing and conveying the debris away from the hopper means while the power broom is being operated.

17. Vacuum operated debris removal apparatus according to claim 16 wherein separate hinge arms interconnect the hood and hopper means at opposite axial ends of the rotating brush of the power broom.

18. A method for removing solid particulate debris from a surface by means of a power broom comprising continuously collecting the debris swept up by the power broom in an enclosed hopper mounted on the power broom and continuously removing the debris from the hopper and conveying the debris away from the hopper and power broom by means of a vacuum removal apparatus, the vacuum removal apparatus including a vacuum source separated from and not carried by the power broom and being connected to the hopper by means of a vacuum hose having an inlet in communication with the debris collected in the hopper.

19. A method according to claim 18 wherein the hopper is provided with an outlet at the bottom thereof and the vacuum is applied to the outlet, such that the downward force of gravity and downward flow of air created by the vacuum draws the debris out of the hopper and into the vacuum hose.

* * * * *